US011248469B2

(12) United States Patent
Kim

(10) Patent No.: US 11,248,469 B2
(45) Date of Patent: Feb. 15, 2022

(54) TURBINE BLADE HAVING COOLING HOLE IN WINGLET AND GAS TURBINE INCLUDING THE SAME

(71) Applicant: DOOSAN HEAVY INDUSTRIES & CONSTRUCTION CO., LTD., Changwon-si (KR)

(72) Inventor: Inkyom Kim, Changwon-si (KR)

( * ) Notice: Subject to any disclaimer, the term of this patent is extended or adjusted under 35 U.S.C. 154(b) by 130 days.

(21) Appl. No.: 16/538,777

(22) Filed: Aug. 12, 2019

(65) Prior Publication Data

US 2020/0102836 A1 Apr. 2, 2020

(30) Foreign Application Priority Data

Oct. 1, 2018 (KR) ..... 10-2018-0117198

(51) Int. Cl.
*F01D 5/20* (2006.01)
*F01D 5/18* (2006.01)

(52) U.S. Cl.
CPC ..... *F01D 5/18* (2013.01); *F01D 5/20* (2013.01); *F05D 2240/24* (2013.01)

(58) Field of Classification Search
CPC ..... F01D 5/20; F01D 11/08; F05D 2240/307
See application file for complete search history.

(56) References Cited

U.S. PATENT DOCUMENTS 4,589,823 A * 5/1986 Koffel ..... F01D 5/20 415/173.4
6,602,052 B2 * 8/2003 Liang ..... F01D 5/18 416/224
7,632,062 B2 * 12/2009 Harvey ..... F01D 5/20 415/115
7,645,123 B1 * 1/2010 Liang ..... F01D 5/20 416/241 R
7,704,047 B2 * 4/2010 Liang ..... F01D 5/20 416/97 R
8,061,987 B1 * 11/2011 Liang ..... F01D 5/187 416/92
8,303,254 B1 * 11/2012 Liang ..... F01D 5/288 416/97 R
8,414,262 B2 * 4/2013 Hada ..... F01D 5/20 416/92
8,414,265 B2 4/2013 Willett
8,777,572 B2 * 7/2014 Cheong ..... F01D 5/20 416/97 R
10,253,637 B2 * 4/2019 Schroeder ..... F01D 5/141
(Continued)

FOREIGN PATENT DOCUMENTS

KR 10-1324249 B1 11/2013

OTHER PUBLICATIONS

The Aero-Thermal Performance of a Cooled Winglet Tip in a High Pressure Turbine Cascade, Paper No. GT2011-46369, pp. 1625-1637; 13 pages.

*Primary Examiner* — Eldon T Brockman
(74) *Attorney, Agent, or Firm* — Harvest IP Law, LLP

(57) ABSTRACT

A turbine blade is provided. The turbine blade may include a blade body including a leading edge, a trailing edge, a suction side, a pressure side, and a tip region, a squealer tip extending upward from the tip region of the blade body, a winglet extending outward from the squealer tip on the suction side of the blade body, and a cooling hole obliquely formed through the winglet to communicate with an inner cavity of the blade body.

20 Claims, 12 Drawing Sheets

(56) References Cited

U.S. PATENT DOCUMENTS

| | | | | |
|---|---|---|---|---|
| 2002/0182074 | A1 | 12/2002 | Bunker | |
| 2005/0232771 | A1* | 10/2005 | Harvey | F01D 5/20 416/97 R |
| 2008/0118367 | A1* | 5/2008 | Liang | F01D 5/186 416/97 R |
| 2010/0054955 | A1 | 3/2010 | Helvaci et al. | |
| 2010/0135813 | A1 | 6/2010 | Marini et al. | |
| 2010/0221122 | A1* | 9/2010 | Klasing | F01D 5/20 416/97 R |
| 2012/0189458 | A1* | 7/2012 | Cheong | F01D 5/20 416/235 |
| 2017/0058680 | A1 | 3/2017 | Chouhan et al. | |
| 2017/0167275 | A1* | 6/2017 | Schroeder | F02C 7/18 |
| 2018/0347375 | A1* | 12/2018 | Beyer | F01D 5/20 |
| 2019/0218918 | A1* | 7/2019 | Schroeder | F02C 7/18 |

* cited by examiner

TURBINE BLADE HAVING COOLING HOLE IN WINGLET AND GAS TURBINE INCLUDING THE SAME

CROSS-REFERENCE TO RELATED APPLICATION

This application claims priority to Korean Patent Application No. 10-2018-0117198, filed on Oct. 1, 2018, the disclosure of which is incorporated herein by reference in its entirety.

BACKGROUND

Field

Apparatuses and methods consistent with exemplary embodiments relate to a turbine blade having a cooling hole in a winglet and a gas turbine including the same.

Description of the Related Art

Turbines are machines that obtain rotational force by impulsive or reaction force using a flow of a compressible fluid such as steam or gas, and include a steam turbine using steam, a gas turbine using hot combustion gas, and so on.

The gas turbine includes a compressor, a combustor, and a turbine. The compressor is provided with an air inlet for introduction of air thereinto, and includes a plurality of compressor vanes and a plurality of compressor blades alternately arranged in a compressor housing.

The combustor supplies fuel to air compressed by the compressor and ignites a fuel-air mixture with a burner to produce high-temperature and high-pressure combustion gas.

The turbine includes a plurality of turbine vanes and a plurality of turbine blades alternately arranged in a turbine housing. In addition, a rotor is arranged to pass through centers of the compressor, the combustor, the turbine, and an exhaust chamber.

The rotor is rotatably supported at both ends thereof by bearings. A plurality of disks are fixed to the rotor, and a plurality of blades are connected to each of the disks while a drive shaft of a generator is connected to an end of the exhaust chamber.

The gas turbine is advantageous in that consumption of lubricant is extremely low due to an absence of mutual friction parts such as a piston-cylinder because the gas turbine does not have a reciprocating mechanism such as a piston in a four-stroke engine. Therefore, an amplitude, which is a characteristic of reciprocating machines, is greatly reduced, and the gas turbine has an advantage of high-speed motion.

The operation of the gas turbine is briefly described. That is, the air compressed by the compressor is mixed with fuel for combustion to produce high-temperature and high-pressure combustion gas which is injected into the turbine, and the injected combustion gas generates rotational force while passing through the turbine vanes and turbine blades, thereby rotating the rotor.

SUMMARY

Aspects of one or more exemplary embodiments provide a turbine blade capable of effectively cooling a squealer rim by forming a winglet on a suction side and forming a cooling hole through a diagonal region of the winglet.

Additional aspects will be set forth in part in the description which follows and, in part, will become apparent from the description, or may be learned by practice of the exemplary embodiments.

According to an aspect of an exemplary embodiment, there is provided a turbine blade including: a blade body including a leading edge, a trailing edge, a suction side, a pressure side, and a tip region; a squealer tip extending upward from the tip region of the blade body; a winglet extending outward from the squealer tip on the suction side of the blade body; and a cooling hole obliquely formed through the winglet to communicate with an inner cavity of the blade body.

The winglet may include an upper surface extending from an upper surface of the squealer tip, a side surface having a height less than the squealer tip, and a lower surface obliquely connected from a lower end of the side surface to the suction side.

The cooling hole may communicate from an upper surface of the winglet to an upper suction-side edge of the inner cavity.

The winglet may be formed throughout the suction side at the squealer tip, and the cooling hole may include a plurality of cooling holes spaced apart from each other at predetermined intervals along the winglet.

The winglet may be formed upstream of the suction side at the squealer tip, and the cooling hole may include a plurality of cooling holes spaced apart from each other at predetermined intervals along the winglet.

The winglet may be formed on the leading edge and throughout the suction side at the squealer tip, and the cooling hole may include a plurality of cooling holes spaced apart from each other at predetermined intervals along the winglet.

The winglet may be formed on the leading edge and upstream of the suction side at the squealer tip, and the cooling hole may include a plurality of cooling holes spaced apart from each other at predetermined intervals along the winglet.

The cooling hole may communicate from a side surface of the winglet to an upper suction-side edge of the cavity.

The turbine blade may further include a second cooling hole formed through the tip region to cool an upper portion of the tip region.

The turbine blade may further include a third cooling hole formed through the suction side to reduce a vortex due to a tip leakage flow.

According to an aspect of another exemplary embodiment, there is provided a gas turbine including: a compressor configured to compress air; a combustor configured to mix compressed air supplied from the compressor with fuel for combustion; and a turbine including a plurality of turbine blades rotated by combustion gas to generate power, wherein each of the turbine blades may include a blade body including a leading edge, a trailing edge, a suction side, a pressure side, and a tip region, a squealer tip extending upward from the tip region of the blade body, a winglet extending outward from the squealer tip on the suction side of the blade body, and a cooling hole obliquely formed through the winglet to communicate with an inner cavity of the blade body.

The winglet may include an upper surface extending from an upper surface of the squealer tip, a side surface having a height less than the squealer tip, and a lower surface obliquely connected from a lower end of the side surface to the suction side.

The cooling hole may communicate from an upper surface of the winglet to an upper suction-side edge of the cavity.

The winglet may be formed throughout the suction side at the squealer tip, and the cooling hole may include a plurality of cooling holes spaced apart from each other at predetermined intervals along the winglet.

The winglet may be formed upstream of the suction side at the squealer tip, and the cooling hole may include a plurality of cooling holes spaced apart from each other at predetermined intervals along the winglet.

The winglet may be formed on the leading edge and throughout the suction side at the squealer tip, and the cooling hole may include a plurality of cooling holes spaced apart from each other at predetermined intervals along the winglet.

The winglet may be formed on the leading edge and upstream of the suction side at the squealer tip, and the cooling hole may include a plurality of cooling holes spaced apart from each other at predetermined intervals along the winglet.

The cooling hole may communicate from a side surface of the winglet to an upper suction-side edge of the cavity.

The turbine blade may further include a second cooling hole formed through the tip region to cool an upper portion of the tip region.

The turbine blade may further include a third cooling hole formed through the suction side to reduce a vortex due to a tip leakage flow.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
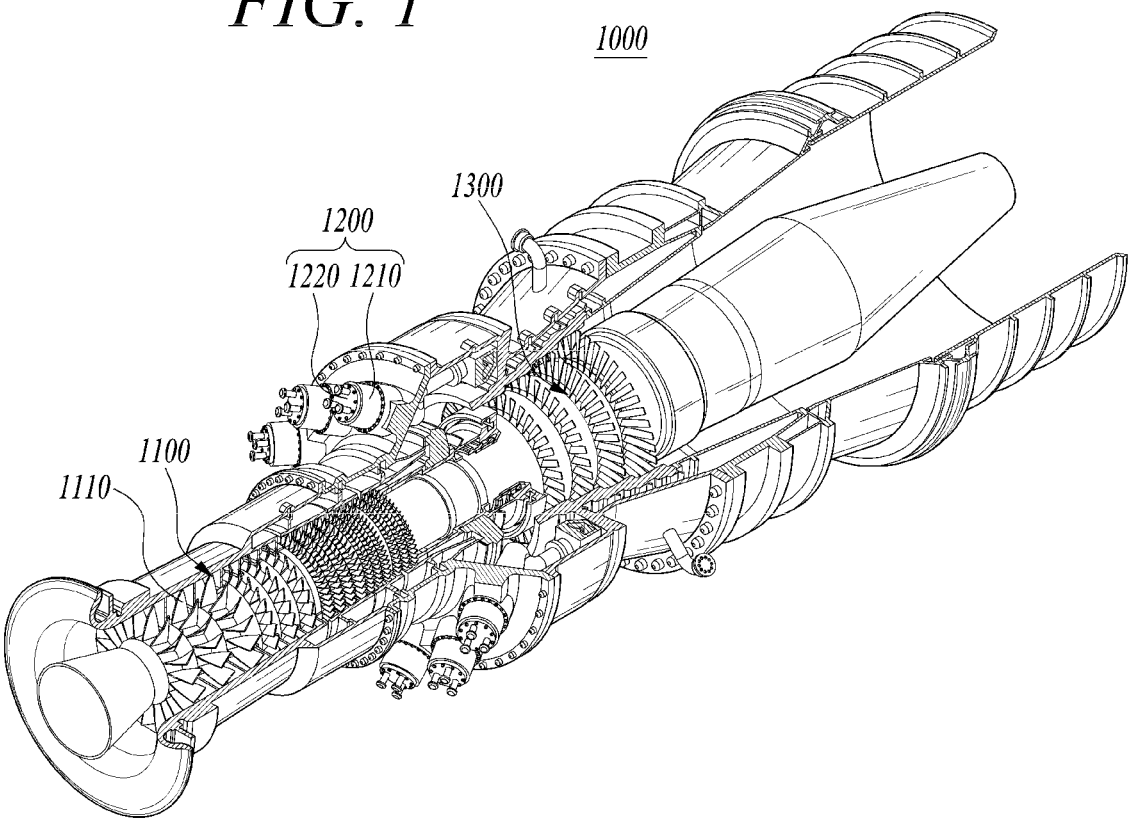
FIG. 1 is a partially cutaway perspective view illustrating a gas turbine according to an exemplary embodiment.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used in the disclosure is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Hereinafter, exemplary embodiments will be described in detail with reference to the accompanying drawings. Throughout the disclosure, like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

Figure 2:
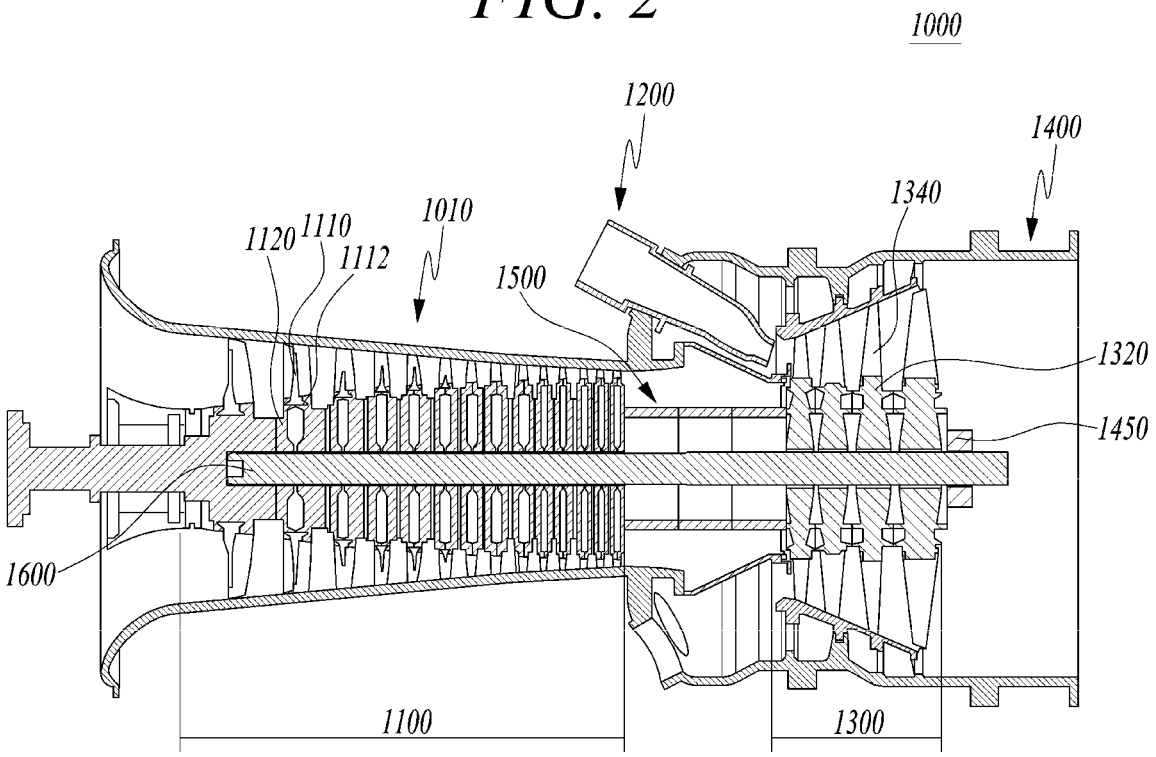
FIG. 2 is a cross-sectional view illustrating a schematic structure of the gas turbine according to the exemplary embodiment.
Figure 3:
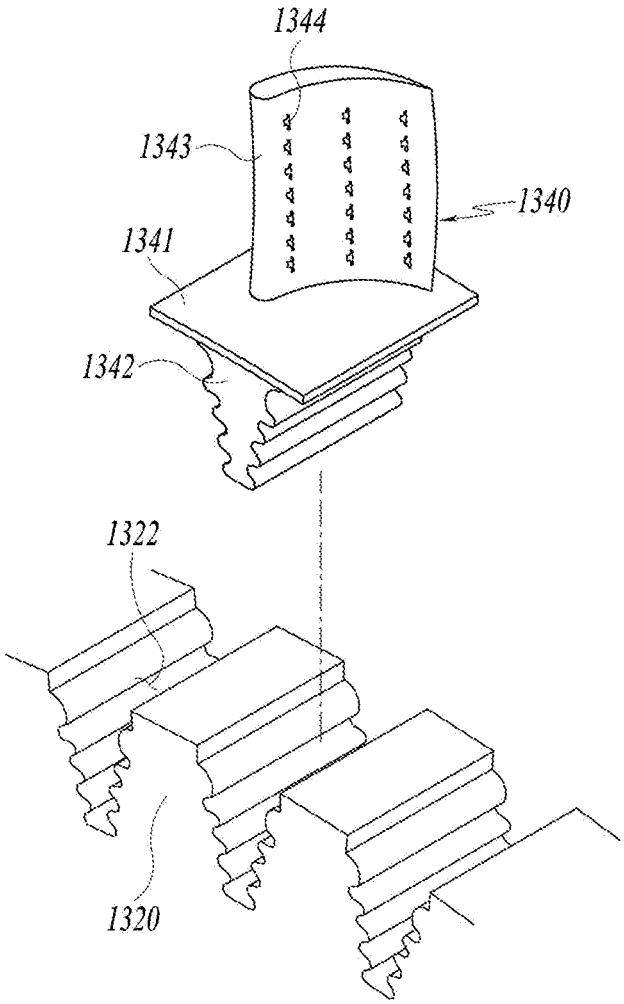
FIG. 3 is an exploded perspective view illustrating a turbine rotor disk of FIG. 2.

FIG. 1 is a partially cutaway perspective view illustrating a gas turbine according to an exemplary embodiment. FIG. 2 is a cross-sectional view illustrating a schematic structure of the gas turbine according to the exemplary embodiment. FIG. 3 is an exploded perspective view illustrating the turbine rotor disk of FIG. 2.

Referring to FIG. 1, the gas turbine 1000 may include a compressor 1100, a combustor 1200, and a turbine 1300. The compressor 1100 including a plurality of blades 1110 arranged radially rotates the blades 1110, and air is compressed by rotation of the blades 1110 and flows. A size and installation angle of each of the blades 1110 may vary depending on an installation position thereof. The compressor 1100 may be directly or indirectly connected to the turbine 1300 to receive some of the power generated by the turbine 1300 and use it to rotate the blades 1110.

The air compressed in the compressor 1100 flows to the combustor 1200. The combustor 1200 may include a plurality of chambers 1210 and fuel nozzle modules 1220 arranged annually.

Referring to FIG. 2, the gas turbine 1000 according to the exemplary embodiment may include a housing 1010 and a diffuser 1400 disposed behind the housing 1010 to discharge the combustion gas passing through the turbine 1300. The combustor 1200 is disposed in front of the diffuser 1400 to combust the compressed air supplied thereto.

Based on the direction of an air flow, the compressor 1100 is disposed at an upstream side, and the turbine 1300 is disposed at a downstream side. A torque tube 1500 serving as a torque transmission member for transmitting the rotational torque generated in the turbine 1300 to the compressor 1100 is disposed between the compressor 1100 and the turbine 1300.

The compressor 1100 includes a plurality of compressor rotor disks 1120, each of which is fastened by a tie rod 1600 to prevent axial separation in an axial direction of the tie rod 1600.

For example, the compressor rotor disks 1120 are axially aligned in a state in which the tie rod 1600 constituting a rotary shaft passes through the centers of the compressor rotor disks 1120. Here, adjacent compressor rotor disks 1120 are arranged so that facing surfaces thereof are in tight contact with each other by being pressed by the tie rod 1600. The adjacent compressor rotor disks 1600 cannot rotate because of this arrangement.

Each of the compressor rotor disks 1120 has a plurality of compressor blades 1110 radially coupled to an outer peripheral surface thereof. Each of the compressor blades 1110 has a dovetail 1112 fastened to the compressor rotor disk 1120.

A plurality of compressor vanes are fixedly arranged between each of the compressor rotor disks 1120 in the housing 1010. While the compressor rotor disks 1120 rotate along with a rotation of the tie rod 1600, the compressor vanes fixed to the housing 1010 do not rotate. The compressor vanes guide the flow of the compressed air moved from front-stage compressor blades 1110 to rear-stage compressor blades 1110.

The dovetail 1112 may be fastened by a tangential type or an axial type, which may be selected according to a structure of a gas turbine. The dovetail 1112 may have a dovetail shape or a fir-tree shape. In some cases, the compressor blades 1110 may be fastened to the compressor rotor disks 1120 by using other types of fastening members, such as a key or a bolt.

The tie rod 1600 is disposed to pass through centers of the plurality of compressor rotor disks 1120 and turbine rotor disks 1320. The tie rod 1600 may be a single tie rod or a plurality of tie rods. One end of the tie rod 1600 is fastened to the most upstream compressor rotor disk and the other end thereof is fastened by a fastening nut 1450.

It is understood that the type of the tie rod 1600 may not be limited to the example illustrated in FIG. 2, and may be changed or vary according to one or more other exemplary embodiments. For example, a single tie rod may be disposed to pass through the centers of the rotor disks, a plurality of tie rods may be arranged circumferentially, or a combination thereof may be used.

Also, in order to increase the pressure of a fluid and adjust an actual inflow angle of the fluid entering into an inlet of the combustor, a deswirler serving as a guide vane may be installed at the rear stage of the diffuser of the compressor 1100 so that the actual inflow angle matches a designed inflow angle.

The combustor 1200 mixes the introduced compressed air with fuel, burns a fuel-air mixture to produce high-temperature and high-pressure combustion gas with high energy, and increases the temperature of the combustion gas to a temperature at which the combustor and the turbine are able to be resistant to heat through an isobaric combustion process.

A plurality of combustors constituting the combustor 1200 may be arranged in the housing in a form of a cell. Each of the combustors may include a burner having a fuel injection nozzle and the like, a combustor liner defining a combustion chamber, and a transition piece serving as a connection between the combustor and the turbine.

The combustor liner provides a combustion space in which the fuel injected by the fuel injection nozzle and the compressed air supplied from the compressor are mixed and burned. The combustor liner may include a flame container to provide the combustion space in which the mixture of air and fuel is burned, and a flow sleeve defining an annular space while surrounding the flame container. The fuel injection nozzle is coupled to a front end of the combustor liner, and an ignition plug is coupled to a sidewall of the combustor liner.

The transition piece is connected to a rear end of the combustor liner to transfer the combustion gas toward the turbine. An outer wall of the transition piece is cooled by the compressed air supplied from the compressor to prevent the transition piece from being damaged due to the high temperature of the combustion gas.

To this end, the transition piece has cooling holes through which the compressed air is injected, and the compressed air cools the inside of the transition piece and then flows toward the combustor liner.

The compressed air that has cooled the transition piece may flow into an annular space of the combustor liner, and may be supplied as a cooling air through the cooling hole formed in the flow sleeve from the outside of the flow sleeve to an outer wall of the combustor liner.

The high-temperature and high-pressure combustion gas ejected from the combustor 1200 is supplied to the turbine 1300. The supplied high-temperature and high-pressure combustion gas expands and applies impingement or reaction force to the turbine blades to generate rotational torque. A portion of the rotational torque is transmitted via the torque tube to the compressor 1100, and the remaining portion which is the excessive torque is used to drive a generator or the like.

The turbine 1300 basically has a structure similar to the compressor 1100. That is, the turbine 1300 may include a plurality of turbine rotor disks 1320 similar to the compressor rotor disks 1120 of the compressor 1100, and each of the turbine rotor disks 1320 may include a plurality of turbine blades 1340 arranged radially. The turbine blades 1340 may be coupled to the turbine rotor disk 1320 in a dovetail coupling manner. In addition, turbine vanes fixed to the housing 1010 are provided between the turbine blades 1340 of the turbine rotor disks 1320 to guide a flow direction of the combustion gas passing through the turbine blades 1340.

Referring to FIG. 3, each of the turbine rotor disks 1320 has a substantially disk shape, and includes a plurality of coupling slots 1322 formed on the outer peripheral portion thereof. Each of the coupling slots 1322 has a fir-tree-shaped curved surface.

Each of the turbine blades 1340 is fastened to the associated coupling slot 1322 and includes a flat platform part 1341 formed at a center thereof. A side of the platform part 1341 is in contact with a side of the platform part 1341 of an adjacent turbine blade to maintain a distance between the turbine blades.

A root part 1342 is formed on a back of the platform part 1341. The root part 1342 has an axial-type structure in which it is inserted into the coupling slot 1322 of the rotor disk 1320 in the axial direction of the rotor disk 1320.

The root part 1342 has a substantially fir-tree-shaped curved portion corresponding to the curved portion formed in the coupling slot 1322. It is understood that the root part 1342 may not be limited to the coupling structure illustrated in FIG. 3 does not necessarily have a coupling structure in the form of a fir tree, and may have a dovetail shape.

A blade part 1343 is formed on an upper surface of the platform part 1341 to have an optimized airfoil shape according to the specification of the gas turbine. On the basis of the flow direction of combustion gas, the blade part 1343 has a leading edge disposed at an upstream side and a trailing edge disposed at a downstream side.

The turbine blades 1340 come into direct contact with the high-temperature and high-pressure combustion gas. Because the temperature of the combustion gas is as high as 1700° C., a cooling means is needed. To this end, a cooling passage is defined in which some of the air compressed is blown from some points of the compressor and supplied to the turbine.

The cooling passage may extend outside the housing (i.e., an external passage) or may extend through the inside of the rotor disk (i.e., an internal passage), or both of the external passage and the internal passage may be used. The blade part 1343 includes a plurality of film cooling holes 1344 formed on the surface thereof, and the film cooling holes 1344 communicate with a cooling passage defined in the blade part 1343 to supply cooling air to the surface of the blade part 1343.

The blade part 1343 is rotated by the combustion gas in the housing. There is a clearance between a tip of the blade part 1343 and the inner surface of the housing such that the blade part 1343 is smoothly rotatable. However, because the combustion gas may leak through the clearance, a sealing means for blocking the leakage of the combustion gas is required.

Each of the turbine blades 1340 generally includes a leading edge, a trailing edge, a pressure side, a suction side, and a tip region. A tip clearance that enables relative movement between the turbine blade and the inner peripheral surface of the housing is present in the tip region of the turbine blade.

Due to the pressure difference between the turbine blade and the cooling passage which are adjacent to each other, a strong secondary flow occurs from the pressure side of the turbine blade to the suction side thereof through the tip clearance, which is referred to as a tip leakage flow.

The tip leakage flow passes through the tip clearance and moves downstream in a spiral shape along the suction side. A three-dimensional flow such as a tip leakage vortex occurring near the tip clearance increases a pressure loss, resulting in a reduction in the efficiency of the turbine stage. The pressure loss due to the tip leakage flow increases in proportion to a leakage flow rate, which is known to account for approximately 30% of the total pressure loss.

In order to reduce the pressure loss due to such a tip leakage flow, the high-pressure turbine blade adopts a squealer tip. The squealer tip, also referred to as a recessed tip, includes a fenced protrusion on the edge thereof and a recessed hollow space therein.

A turbine blade having a squealer tip formed on the front surface thereof reduces a tip leakage flow, compared to a turbine blade having a flat tip.

However, if a cooling hole is formed at the squealer tip to cool a squealer rim, there is a problem in that the cooling hole interferes with the bottom edge of the recessed tip.

Therefore, it is difficult to form the cooling hole at the squealer rim, which makes it difficult to cool the squealer rim.

Figure 4:
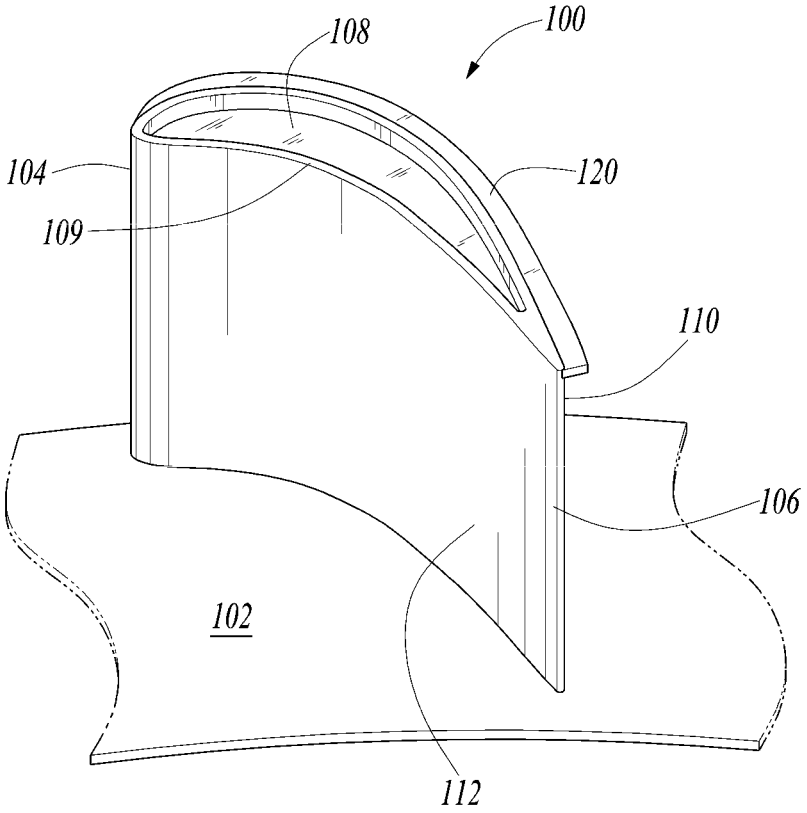
FIG. 4 is a perspective view illustrating a turbine blade according to an exemplary embodiment.
Figure 5:
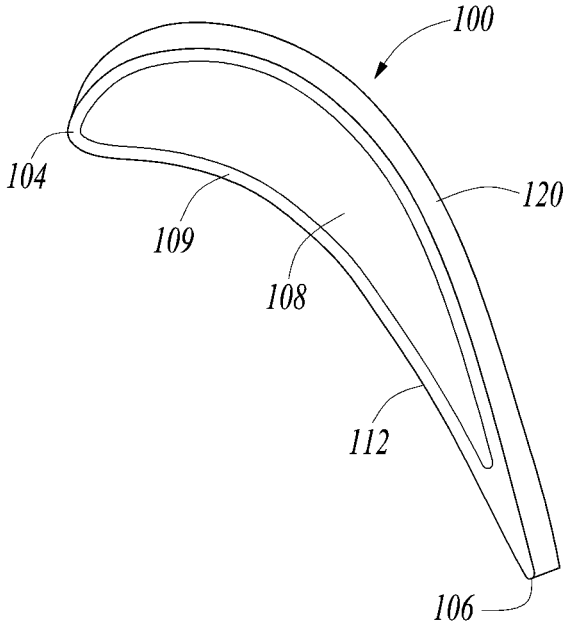
FIG. 5 is a top view illustrating the turbine blade of FIG. 4.
Figure 6:
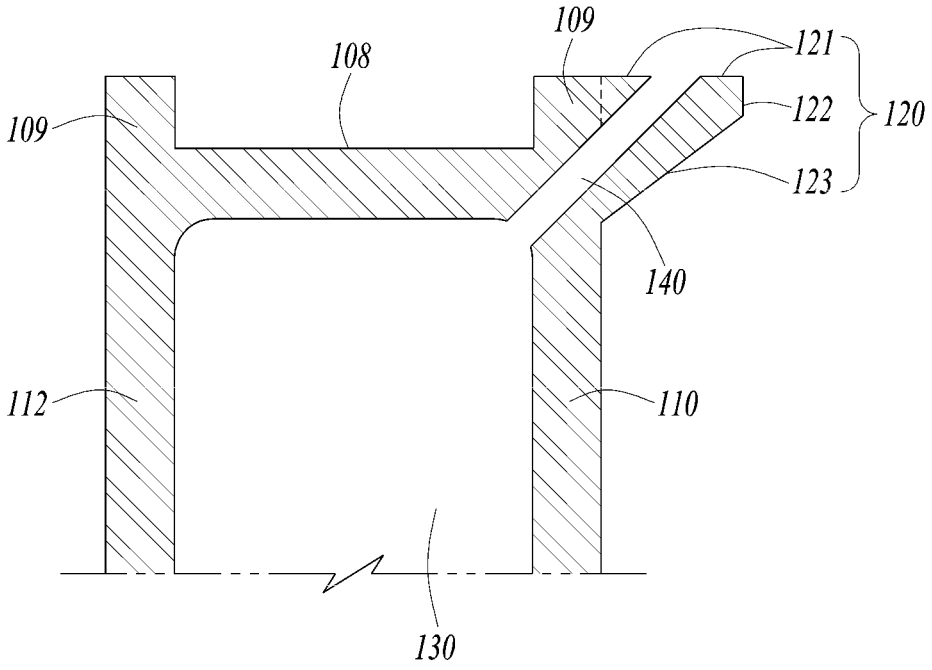
FIG. 6 is a longitudinal cross-sectional view illustrating the turbine blade of FIG. 4.

FIG. 4 is a perspective view illustrating a turbine blade according to an exemplary embodiment. FIG. 5 is a top view illustrating the turbine blade of FIG. 4. FIG. 6 is a longitudinal cross-sectional view illustrating the turbine blade of FIG. 4.

Referring to FIGS. 4 to 6, the turbine blade 100 may include a blade body 100, a squealer tip 109, a winglet 120, and a cooling hole 140 drilled through the winglet 120.

The blade body 100 has an airfoil shape and includes a leading edge 104, a trailing edge 106, a suction side 110, a pressure side 112, and a tip region 108. The tip region 108 constitutes an upper surface of the blade body 100.

The squealer tip 109 extends upward from the tip region 108 of the blade body 100 and forms a squealer rim on the upper surface of the tip region 108.

The winglet 120 extends outward from the squealer tip 109 on the suction side 110 of the blade body 100. That is, the winglet 120 may extend horizontally from at least a portion of the suction side 110 on the outer surface of the squealer tip 109. Thus, the winglet 120 may be formed integrally with the squealer tip 109.

The winglet 120 may serve to weaken the tip leakage vortex that may be formed while the cooling air passing through the clearance between the squealer tip 109 on the suction side 110 and the inner wall of the housing flows, thereby further reducing the pressure loss. Forming the winglet 120 on the suction side 110 may provide superior aerodynamic performance, compared to forming the winglet 120 on the pressure side 112.

The cooling hole 140 may be obliquely drilled through the winglet 120 to communicate with an inner cavity 130 of the blade body 100.

The winglet 120 may include an upper surface 121 extending from the upper surface of the squealer tip 109, a side surface 122 having a height less than the squealer tip 109, and a lower surface 123 obliquely connected from a lower end of the side surface 122 to the suction side 110.

The upper surface 121 of the winglet 120 may extend horizontally at the same height as the upper surface of the squealer tip 109.

The side surface 122 of the winglet 120 may be formed vertically, i.e., radially, similar to the suction side 110, and the height of the side surface 122 may be slightly less than the extended height of the squealer tip 109.

The lower surface 123 of the winglet 120 may be inclined at an angle of 30 to 60 degrees from the lower end of the side surface 122 and connected to the suction side 110.

The cooling hole 140 may be formed by drilling through the turbine blade integrally with the winglet using a drill having a predetermined diameter.

The cooling hole 140 may communicate from the upper surface 121 of the winglet 120 to the upper suction-side edge of the cavity 130. Because the lower surface 123 of the winglet 120 is inclined, the cooling hole 140 may also be inclined at an angle similar to the angle of inclination of the lower surface 123.

The cooling air serves to block the flow of air flowing through the tip clearance while being discharged to the upper surface 121 of the winglet 120 through the cooling hole 140, thereby reducing the tip leakage flow.

In the turbine blade 100 of FIG. 5, the winglet 120 may be formed throughout the suction side 110 at the squealer tip 109, and the cooling hole 140 may include a plurality of cooling holes spaced apart from each other at predetermined intervals along the winglet 120.

The cooling holes 140 may be formed at predetermined intervals at a position in which the cooling holes 140 may communicate with the cavity 130 in the winglet 120 formed on the suction side 110.

Figure 7:
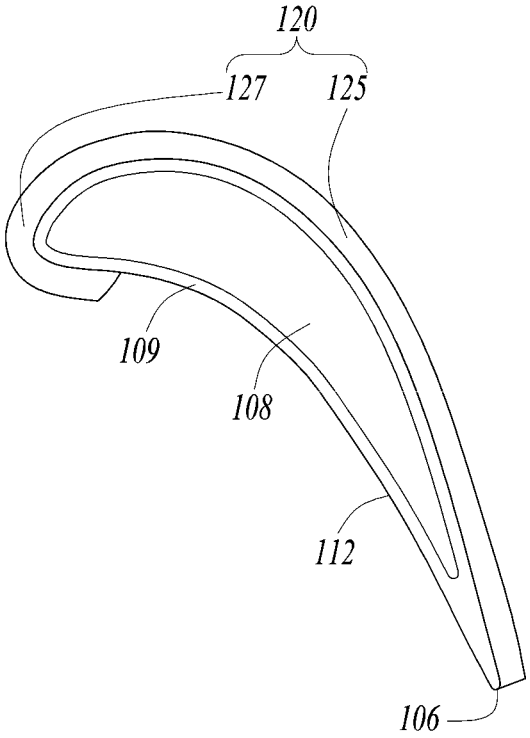
FIG. 7 is a top view illustrating a turbine blade according to an exemplary embodiment.
Figure 8:
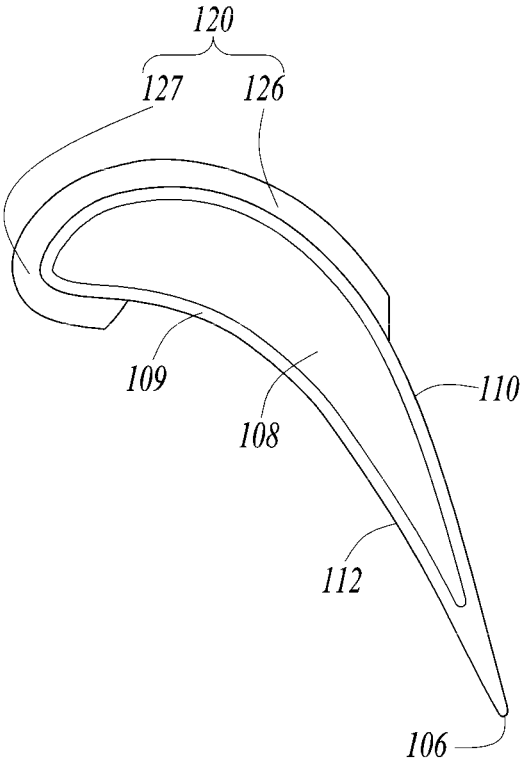
FIG. 8 is a top view illustrating a turbine blade according to an exemplary embodiment.
Figure 9:
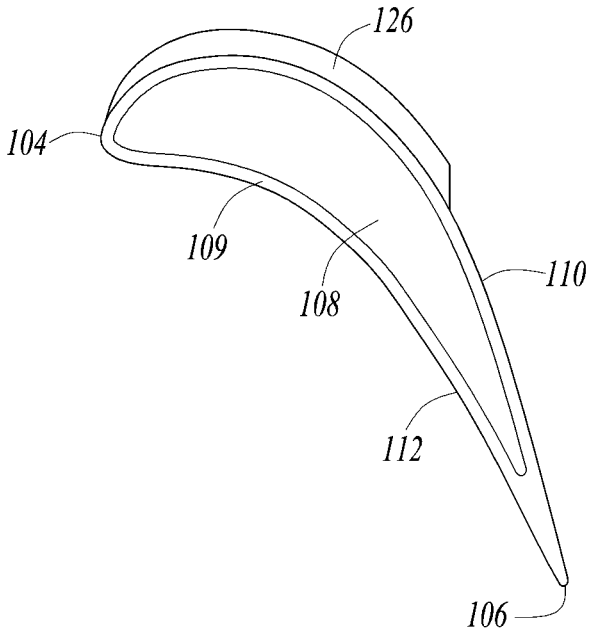
FIG. 9 is a top view illustrating a turbine blade according to an exemplary embodiment.

FIGS. 7 to 9 are top views illustrating a turbine blade with a different type of winglet.

Referring to FIG. 7, a winglet 120 may be formed on the leading edge 104 and throughout the suction side 110 at the squealer tip 109, and a plurality of cooling holes 140 may be spaced apart from each other at predetermined intervals along the winglet 120.

The winglet 120 may include a first portion 127 formed on the leading edge 104 and a second portion 125 formed over the entire suction side 110 at the squealer tip 109. The portion first 127 formed on the leading edge 104 is positioned, at one side thereof, on the pressure side 112.

In this case, the cooling holes 140 may be formed at predetermined intervals only in the second portion 125 formed on the suction side 110.

Referring to FIG. 8, a winglet 120 may be formed on the leading edge 104 and upstream of the suction side 110 at the squealer tip 109, and a plurality of cooling holes 140 may be spaced apart from each other at predetermined intervals along the winglet 120.

The winglet 120 may include a first portion 127 formed on the leading edge 104 and a second portion 126 formed upstream of the suction side 110 at the squealer tip 109. The first portion 127 formed on the leading edge 104 is positioned, at one side thereof, on the pressure side 112.

In this case, the cooling holes 140 may be formed at predetermined intervals only in the second portion 126 formed upstream of the suction side 110.

Referring to FIG. 9, a winglet 120 may be formed upstream of the suction side 110 at the squealer tip 109, and a plurality of cooling holes 140 may be spaced apart from each other at predetermined intervals along the winglet 120.

The winglet 120 may include a portion 126 formed upstream of the suction side 110 at the squealer tip 109.

In this case, the cooling holes 140 may be formed at predetermined intervals in the portion 126 formed upstream of the suction side 110.

Figure 10:
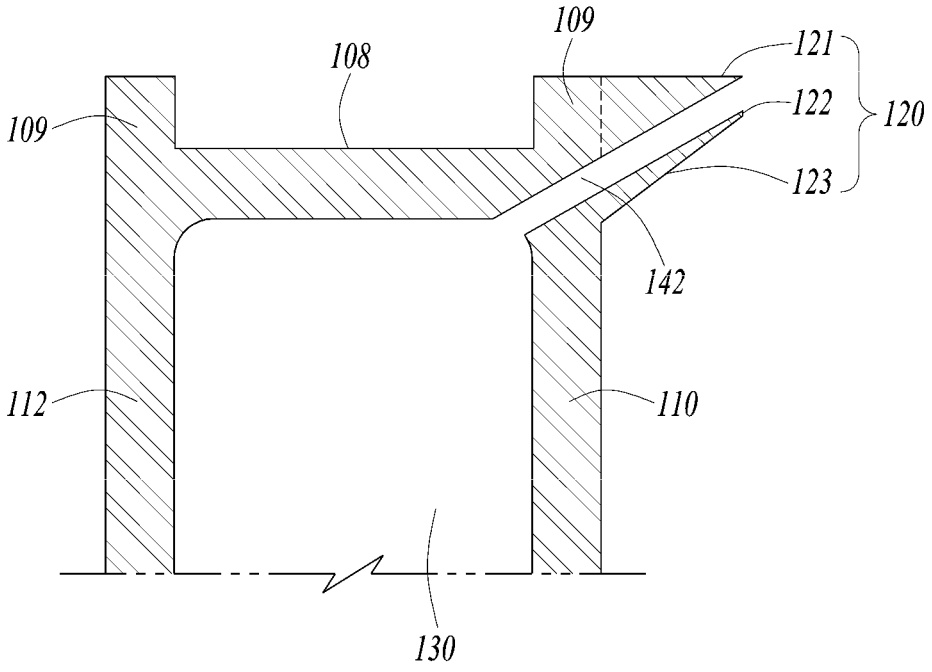
FIG. 10 is a longitudinal cross-sectional view illustrating a turbine blade according to an exemplary embodiment.
Figure 11:
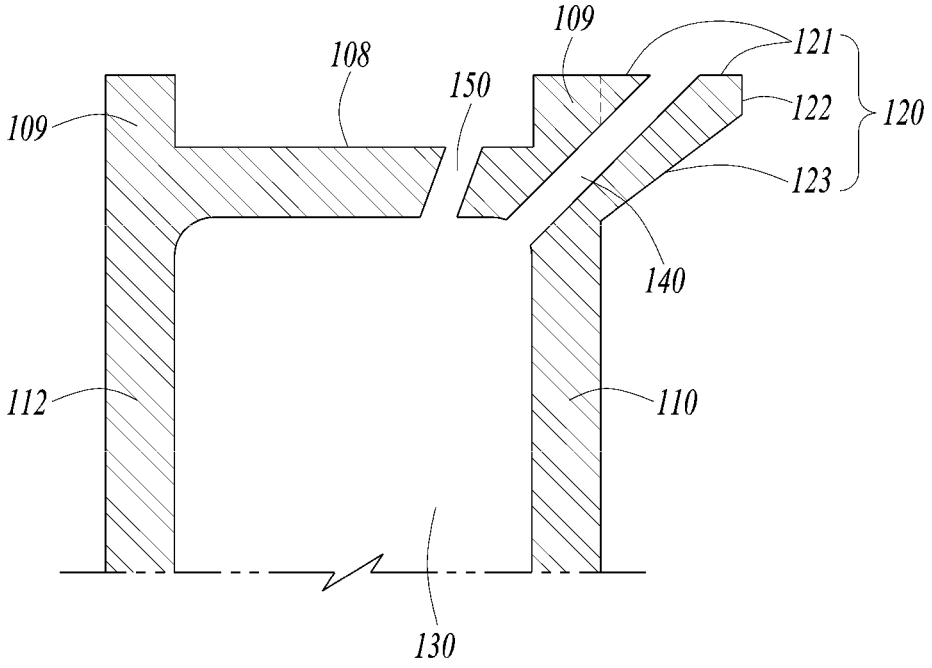
FIG. 11 is a longitudinal cross-sectional view illustrating a turbine blade according to an exemplary embodiment.
Figure 12:
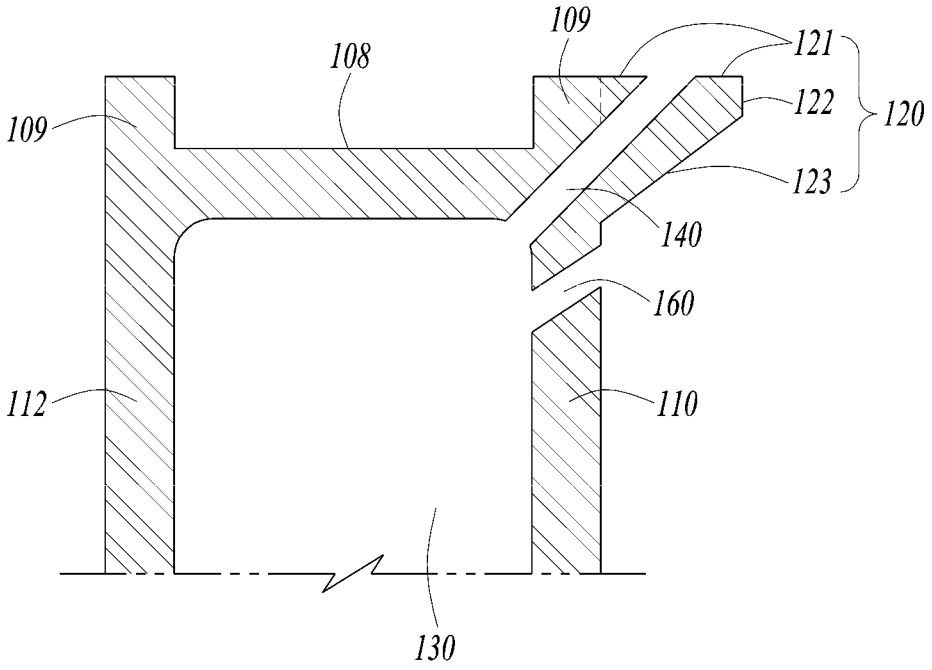
FIG. 12 is a longitudinal cross-sectional view illustrating a turbine blade according to an exemplary embodiment.

FIGS. 10 to 12 are longitudinal cross-sectional views illustrating a turbine blade with a different type of cooling hole.

Referring to FIG. 10, a cooling hole 142 may communicate from a side surface 122 of the winglet 120 to an edge on an upper suction side 110 of the cavity 130.

The outlet of the cooling hole 142 formed in the side surface 122 of the winglet 120 may be flush with the side surface 122. On the contrary, the outlet of the cooling hole 142 may have a height less than the side surface 122.

Forming the outlet of the cooling hole 142 on the side surface 122 of the winglet 120 can enhance aerodynamic performance.

Referring to FIG. 11, the turbine blade may further include a second cooling hole 150 formed through the tip region 108 to cool the upper portion of the tip region 108.

The cooling air discharged through the second cooling hole 150 may cool a hot spot on the tip region 108 heated by the hot air flowing through the tip gap. To this end, the second cooling hole 150 may be slightly inclined toward the suction side 110 from bottom to top.

Referring to FIG. 12, the turbine blade may further include a third cooling hole 160 formed through the suction side 110 to reduce the vortex due to a tip leakage flow.

The cooling air discharged through the third cooling hole 160 may collapse the vortex formed by the tip leakage flow, thereby reducing a loss. To this end, the third cooling hole 160 may be slightly inclined toward the winglet 120 outward of the suction side 110 from the cavity 130.

Both of the second and third cooling holes 150 and 160 may be formed with the cooling hole 140. Alternatively, the second cooling hole 150 and/or the third cooling hole 160 may be formed with the cooling holes 142 of FIG. 10. Alternatively, the second cooling hole 150 and/or the third cooling hole 160 may be formed in an exemplary embodiment in which a different type of winglet 120 is formed.

According to the turbine blade of the exemplary embodiments, it is possible to reduce the vortex due to the tip leakage flow by forming the winglet on the suction side and to effectively cool the squealer rim by drilling the cooling hole through the diagonal region of the winglet.

While one or more exemplary embodiments have been described with reference to the accompanying drawings, it is to be understood by those skilled in the art that various modifications and changes in form and details can be made therein without departing from the spirit and scope as defined by the appended claims. Therefore, the description of the exemplary embodiments should be construed in a descriptive sense only and not to limit the scope of the claims, and many alternatives, modifications, and variations will be apparent to those skilled in the art.

What is claimed is:

1. A turbine blade comprising:

a blade body comprising a leading edge, a trailing edge, a suction side, a pressure side, and a tip region;

a squealer tip extending upward from the tip region of the blade body and forming a squealer rim at an upper end thereof;

a winglet extending outward in a horizontal direction from an outer surface of the squealer rim of the squealer tip on the suction side of the blade body; and a cooling hole formed obliquely in a straight shape through the winglet to communicate with an inner cavity of the blade body by drilling with a predetermined diameter through a diagonal region of the winglet, wherein the winglet comprises a side surface formed in a radial direction and having a height less than the squealer tip.

2. The turbine blade according to claim 1, wherein the winglet further comprises:

an upper surface extending from an upper surface of the squealer tip; and a lower surface obliquely connected from a lower end of the side surface to the suction side.

3. The turbine blade according to claim 2, wherein the cooling hole communicates from the upper surface of the winglet to an upper suction-side edge of the inner cavity.

4. The turbine blade according to claim 3, further comprising a second cooling hole formed through the tip region to cool an upper portion of the tip region.

5. The turbine blade according to claim 3, further comprising a third cooling hole formed through the suction side to reduce a vortex due to a tip leakage flow.

6. The turbine blade according to claim 2, wherein the cooling hole communicates from the side surface of the winglet to an upper suction-side edge of the inner cavity.

7. The turbine blade according to claim 1, wherein the winglet is formed throughout the suction side at the squealer tip, and the cooling hole includes a plurality of cooling holes spaced apart from each other at predetermined intervals along the winglet.

8. The turbine blade according to claim 1, wherein the winglet is formed upstream of the suction side at the squealer tip, and the cooling hole includes a plurality of cooling holes spaced apart from each other at predetermined intervals along the winglet.

9. The turbine blade according to claim 1, wherein the winglet is formed on the leading edge and throughout the suction side at the squealer tip, and the cooling hole includes a plurality of cooling holes spaced apart from each other at predetermined intervals along the winglet.

10. The turbine blade according to claim 1, wherein the winglet is formed on the leading edge and upstream of the suction side at the squealer tip, and the cooling hole includes a plurality of cooling holes spaced apart from each other at predetermined intervals along the winglet.

11. A gas turbine comprising:

a compressor configured to compress air;

a combustor configured to mix compressed air supplied from the compressor with fuel for combustion; and a turbine comprising a plurality of turbine blades rotated by combustion gas to generate power, wherein each of the turbine blades comprises:

a blade body comprising a leading edge, a trailing edge, a suction side, a pressure side, and a tip region;

a squealer tip extending upward from the tip region of the blade body and forming a squealer rim at an upper end thereof;

a winglet extending outward in a horizontal direction from an outer surface of the squealer rim of the squealer tip on the suction side of the blade body; and a cooling hole formed obliquely in a straight shape through the winglet to communicate with an inner cavity of the blade body by drilling with a predetermined diameter through a diagonal region of the winglet, wherein the winglet comprises a side surface formed in a radial direction and having a height less than the squealer tip.

12. The gas turbine according to claim 11, wherein the winglet further comprises:

an upper surface extending from an upper surface of the squealer tip; and a lower surface obliquely connected from a lower end of the side surface to the suction side.

13. The gas turbine according to claim 12, wherein the cooling hole communicates from the upper surface of the winglet to an upper suction-side edge of the inner cavity.

14. The gas turbine according to claim 13, wherein the turbine blade further comprises a second cooling hole formed through the tip region to cool an upper portion of the tip region.

15. The gas turbine according to claim 13, wherein the turbine blade further comprises a third cooling hole formed through the suction side to reduce a vortex due to a tip leakage flow.

16. The gas turbine according to claim 12, wherein the cooling hole communicates from the side surface of the winglet to an upper suction-side edge of the inner cavity.

17. The gas turbine according to claim 11, wherein the winglet is formed throughout the suction side at the squealer tip, and the cooling hole includes a plurality of cooling holes spaced apart from each other at predetermined intervals along the winglet.

18. The gas turbine according to claim 11, wherein the winglet is formed upstream of the suction side at the squealer tip, and the cooling hole includes a plurality of cooling holes spaced apart from each other at predetermined intervals along the winglet.

19. The gas turbine according to claim 11, wherein the winglet is formed on the leading edge and throughout the suction side at the squealer tip, and the cooling hole includes a plurality of cooling holes spaced apart from each other at predetermined intervals along the winglet.

20. The gas turbine according to claim 11, wherein the winglet is formed on the leading edge and upstream of the suction side at the squealer tip, and the cooling hole includes a plurality of cooling holes spaced apart from each other at predetermined intervals along the winglet.

* * * * *